US007195063B2

(12) United States Patent
Nogueira et al.

(10) Patent No.: US 7,195,063 B2
(45) Date of Patent: Mar. 27, 2007

(54) DOWNHOLE SAMPLING APPARATUS AND METHOD FOR USING SAME

(75) Inventors: Matheus Nogueira, Macae (BR); James J. Dunlap, Sugar Land, TX (US); Andrew J. Carnegie, Abu Dhabi (AE); Alejandro Duran, Bologna (IT); Edward Harrigan, Danbury, CT (US); Ricardo Vasques, Sugar Land, TX (US); Nicolas Adur, Capital (AR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/710,743

(22) Filed: Jul. 30, 2004

(65) Prior Publication Data

US 2005/0082059 A1 Apr. 21, 2005

Related U.S. Application Data

(60) Provisional application No. 60/511,212, filed on Oct. 15, 2003, now abandoned.

(51) Int. Cl.
*E21B 49/10* (2006.01)
*E21B 49/08* (2006.01)

(52) U.S. Cl. ..... 166/264; 166/100; 175/59; 73/152.17; 73/152.24; 73/152.28

(58) Field of Classification Search ..... 73/152.17, 73/152.24, 152.28; 175/59; 166/264, 100
See application file for complete search history.

(56) References Cited

U.S. PATENT DOCUMENTS 3,611,799 A 10/1969 Davis
3,859,850 A * 1/1975 Whitten et al. ..... 73/152.24
4,416,152 A 11/1983 Wilson
4,860,581 A 8/1989 Zimmerman et al.
4,936,139 A 6/1990 Zimmerman et al.
4,962,665 A * 10/1990 Savage et al. ..... 73/152.28
4,994,671 A 2/1991 Safinya et al.
5,230,244 A * 7/1993 Gilbert ..... 73/152.17
5,303,775 A 4/1994 Michaels et al.
5,335,542 A * 8/1994 Ramakrishnan et al. . 73/152.08
5,377,755 A 1/1995 Michaels et al.
5,934,374 A 8/1999 Hrametz et al.
5,968,370 A * 10/1999 Trim ..... 210/723
6,058,773 A 5/2000 Zimmerman et al.
6,178,815 B1 1/2001 Felling et al.

(Continued)

FOREIGN PATENT DOCUMENTS

GB 2363809 1/2002

(Continued)

*Primary Examiner*—Jennifer H Gay
(74) *Attorney, Agent, or Firm*—Matthias Abrell; Kevin P. McEnaney; William Batzer

(57) ABSTRACT

A method and apparatus for sampling formation fluid includes drawing formation fluid from the subterranean formation into the downhole tool and collecting the formation fluid in a sample chamber. An exit flow line is operatively connected to the sample chamber for selectively removing a contaminated and/or clean portion of the formation fluid from the sample chamber whereby contamination is removed from the sample chamber. For example, a clean portion of the formation fluid may be passed to another sample chamber for collection, or a contaminated portion may be dumped into the borehole.

38 Claims, 4 Drawing Sheets

U.S. PATENT DOCUMENTS

| | | | | |
|---|---|---|---|---|
| 6,223,822 | B1 | 5/2001 | Jones | |
| 6,230,557 | B1 | 5/2001 | Ciglenec et al. | |
| 6,301,959 | B1 | 10/2001 | Hrametz et al. | |
| 6,467,544 | B1 * | 10/2002 | Brown et al. | 166/264 |
| 6,659,177 | B2 | 12/2003 | Bolze et al. | |
| 6,668,924 | B2 * | 12/2003 | Bolze et al. | 166/264 |
| 6,722,432 | B2 * | 4/2004 | Spiers et al. | 166/264 |
| 6,761,215 | B2 | 7/2004 | Morrison et al. | |
| 2002/0098160 | A1 | 7/2002 | Chowhan et al. | |
| 2003/0042021 | A1 | 3/2003 | Bolze et al. | |
| 2003/0066643 | A1 | 4/2003 | Ringgenberg et al. | |
| 2004/0000433 | A1 | 1/2004 | Hill et al. | |
| 2004/0129874 | A1 | 7/2004 | Torgersen et al. | |
| 2005/0150287 | A1 * | 7/2005 | Carnegie et al. | 73/152.28 |

FOREIGN PATENT DOCUMENTS

| | | |
|---|---|---|
| WO | WO 96/30628 | 10/1996 |

* cited by examiner

DOWNHOLE SAMPLING APPARATUS AND METHOD FOR USING SAME

CROSS REFERENCE TO RELATED APPLICATIONS

This application claims the benefit of U.S. Provisional Application No. 60/511,212, filed Oct. 15, 2003 now abandoned.

BACKGROUND OF INVENTION

1. Field of the Invention

This invention relates generally to the evaluation of a formation penetrated by a wellbore. More particularly, this invention relates to downhole sampling tools capable of collecting samples of fluid from a subterranean formation.

2. Description of the Related Art

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a downhole sampling tool, such as the MDT™ wireline formation testing tool, owned and provided by Schlumberger, into the wellbore to collect a sample (or multiple samples) of formation fluid by engagement between a probe member of the sampling tool and the wall of the wellbore. The sampling tool creates a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton).

Various challenges may arise in the process of obtaining samples of fluid from subsurface formations. Again with reference to the petroleum-related industries, for example, the earth around the borehole from which fluid samples are sought typically contains contaminates, such as filtrate from the mud utilized in drilling the borehole. This material often contaminates the clean or "virgin" fluid contained in the subterranean formation as it is removed from the earth, resulting in fluid that is generally unacceptable for hydrocarbon fluid sampling and/or evaluation. As fluid is drawn into the downhole tool, contaminants from the drilling process and/or surrounding wellbore sometimes enter the tool with fluid from the surrounding formation.

To conduct valid fluid analysis of the formation, the fluid sampled preferably possesses sufficient purity to adequately represent the fluid contained in the formation (ie. "virgin" fluid). In other words, the fluid preferably has a minimal amount of contamination to be sufficiently or acceptably representative of a given formation for valid hydrocarbon sampling and/or evaluation. Because fluid is sampled through the borehole, mudcake, cement and/or other layers, it is difficult to avoid contamination of the fluid sample as it flows from the formation and into a downhole tool during sampling. A challenge thus lies in obtaining samples of clean fluid with little or no contamination.

Various methods and devices have been proposed for obtaining subsurface fluids for sampling and evaluation. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 have developed certain probes and related techniques to improve sampling. Other techniques have been developed to separate virgin fluids during sampling. For example, U.S. Pat. Nos. 6,301,959 to Hrametz et al. and discloses a sampling probe with two hydraulic lines to recover formation fluids from two zones in the borehole. Borehole fluids are drawn into a guard zone separate from fluids drawn into a probe zone. U.S. patent application Ser. No. 10/184833, assigned to the assignee of the present invention, provides additional techniques for obtaining clean fluid as the formation fluid is drawn into the downhole tool. Despite such advances in sampling, there remains a need to develop techniques for fluid sampling that optimize the quality of the sample.

In considering existing technology for the collection of subsurface fluids for sampling and evaluation, there remains a need for apparatuses and methods capable of removing contaminated fluid and/or obtaining acceptable formation fluid. It is, therefore, desirable to provide techniques for removing contamination from the downhole tool so that cleaner fluid samples may be captured. It is also desirable to have a system that optimizes the pump utilization and the contamination level of the sample, while reducing the chances of the tool getting stuck. The present invention is directed to a method and apparatus that may solve or at least reduce, some or all of the problems described above.

SUMMARY OF INVENTION

A method and apparatus is provided to sample formation fluid. A downhole sampling tool draws formation fluid from the subterranean formation into the downhole tool. The fluid is drawn into the tool with a pump and collected in a sample chamber. Once the contaminated fluid separates from the formation fluid, the contaminated fluid is removed from the sample chamber and/or the formation fluid is collected in a sample chamber. The fluid may be separated by waiting for separation to occur, agitating the fluid in the sample chamber and/or by adding demulsifying agents.

In at least one aspect, the invention relates to a downhole sampling tool for sampling a formation fluid from a subterranean formation. The downhole tool comprises a probe for drawing the formation fluid from the subterranean formation into the downhole tool, a main flowline extending from the probe for passing the formation fluid from the probe into the downhole tool, at least one sample chamber operatively connected to the main flowline for collecting the formation fluid therein and an exit flow line operatively connected to the sample chamber for selectively removing a contaminated and/or clean portion of the formation fluid from the sample chamber whereby contamination is removed from the formation fluid.

In another aspect, the present invention relates to a method for sampling a formation fluid from a subterranean formation via a downhole tool. The method provides for positioning a downhole tool in a wellbore, establishing fluid communication between the downhole tool and the surrounding formation, drawing fluid from the formation into the downhole tool, collecting the formation fluid in at least one sample chamber and withdrawing one of a contaminated portion of the formation, a clean portion of the formation fluid and combinations thereof from the sample chamber.

In yet another aspect, the present invention relates to a sampling system for removing contamination from a formation fluid collected by a downhole tool from a subterranean formation. The system comprises at least one sample chamber positioned in the downhole tool for receiving the formation fluid and an exit flow line operatively connected to the sample chamber for selectively removing a contaminated and/or a clean portion of the formation fluid from the sample chamber whereby contamination is removed from the formation fluid.

The present invention may also relate to a downhole sampling tool, such as a wireline tool, drilling tool or coiled tubing tool. The sampling tool includes means, such as a probe, for drawing fluid into the downhole tool, a flowline, a pump and at least one sample chamber. The flowline connects the probe to the sample chamber and the pump draws fluid into the downhole tool. The at least one sample chamber is adapted to collect formation fluid for separation therein into clean and contaminated fluid. The clean fluid may be collected by transferring the clean fluid into a separate storage chamber and/or by removing the contaminated fluid from the sample chamber.

The sample chamber may include a first sample chamber and a second sample chamber. A transfer flowline may be used for passing formation fluid from the first sample chamber to the second sample chamber. A dump flowline may also be provided for passing contaminated fluid from the at least one sample chamber to the borehole.

The sample chamber may be provided with sensors to determine formation parameters and/or the separation of the fluid in the sample chamber. The sensors may be positioned in one of the flowlines, the at least one sample chambers and combinations thereof. A fluid analyzer capable of monitoring the fluid content may also be provided.

Separators, such as pebbles, chemicals, demulsifiers or other catalysts or activators, may be placed in the chamber to facilitate separation. The sample chamber may allow for vertical separation of fluid into stacked layers. Alternatively, for example if the tool is spinning, the fluid may separate into radial layers. The sample chamber has a piston slidably movable therein. The piston separates the sample chamber into a sample cavity and a buffer cavity. The piston also separates the sampled fluid from a buffer fluid. Pressure may be applied to the sample fluid and/or to the buffer fluid to manipulate the pressures therein.

The tool may be provided with exit flowline extending from the at least one sample chamber, the exit flowline adapted to remove fluid from the sample chamber. The exit flowline may extend from the at least one sample chamber to the borehole whereby contaminated fluid is dumped from the sample cavity into the borehole. The exit flowline may also extend from the at least one sample chamber to a collection chamber whereby formation fluid is collected.

The exit flowline is provided with a snorkel flowline positionable in the sample chamber for selective removal of fluid therefrom. The tool may be provided with a fluid analysis means, such as an optical fluid analyzer for monitoring the fluid flowing through the tool. The tool may be provided with a gas accumulator to allow gas bubbles to collect before passing into the sample chamber. The gas accumulator is operatively coupled to the sampling flowline and is capable of allow gas bubbles to group together before passing into the sample chamber. Various configurations of flowlines and sample chambers may be used to allow the fluid to be separated into desired modules or removed from the tool.

The invention may also relate to a method for sampling a subterranean formation via a downhole tool. The method comprises positioning a downhole tool in a wellbore, establishing fluid communication between the downhole tool and the surrounding formation, drawing fluid from the formation into the downhole tool, collecting the fluid in a sample chamber, and separating contaminated fluid from the formation fluid.

The fluid may be separated by withdrawing the contaminated fluid from the sample chamber. Alternatively, the fluid may be separated by transferring the clean fluid into a collection chamber. The contaminated fluid may be dumped from the downhole tool. The fluid may be analyzed to identify the clean and/or contaminated fluid. Fluid may be separated by allowing it to settle, by agitation or by providing additives, such as chemicals, pebbles or demulsifiers to facilitate separation.

Other aspects and advantages of the invention will be apparent from the following description and the appended claims.

DETAILED DESCRIPTION

Figure 2:
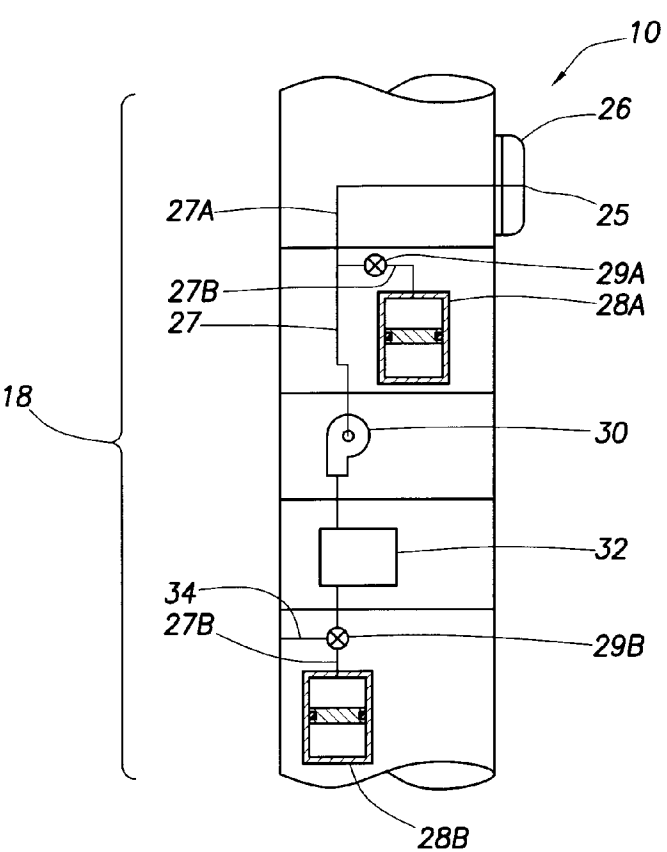
FIG. 2 is a detailed, schematic view of the downhole tool of FIG. 1 depicting a fluid sampling system having a probe, sample chambers, pump and fluid analyzer.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

Figure 1:
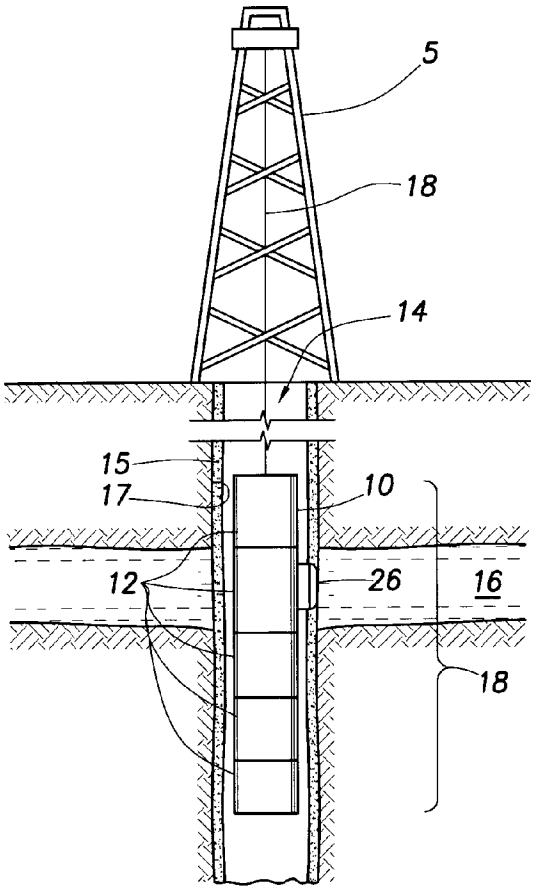
FIG. 1 is a schematic view of a conventional drilling rig and downhole tool.

Referring to FIG. 1, an example environment within which the present invention may be used is shown. In the illustrated example, the present invention is carried by a downhole tool 10. An example commercially available tool 10 is the Modular Formation Dynamics Tester (MDT™) by Schlumberger Corporation, the assignee of the present application and further depicted, for example, in U.S. Pat. Nos. 4,936,139 and 4,860,581 hereby incorporated by reference herein in their entireties.

The downhole tool 10 is deployable into bore hole 14 and suspended therein with a conventional wire line 18, or conductor or conventional tubing or coiled tubing, below a rig 5 as will be appreciated by one of skill in the art. The illustrated tool 10 is provided with various modules and/or components 12, including, but not limited to, a fluid sampling system 18. The fluid sampling system 18 is depicted as having a probe used to establish fluid communication between the downhole tool and the subsurface formation 16. The probe 26 is extendable through the mudcake 15 and to sidewall 17 of the borehole 14 for collecting samples. The samples are drawn into the downhole tool 10 through the probe 26.

While FIG. 1 depicts a modular wireline sampling tool for collecting samples according to the present invention, it will be appreciated by one of skill in the art that such system may be used in any downhole tool. For example, the downhole tool may be a drilling tool including a drill string and a drill bit. The downhole tool may be of a variety of tools, such as a Measurement-While-Drilling (MWD), Logging-While Drilling (LWD), coiled tubing or other downhole system. Additionally, the downhole tool may have alternate configurations, such as modular, unitary, wireline, coiled tubing, autonomous, drilling and other variations of downhole tools.

Referring now to FIG. 2, the fluid sampling system 18 of FIG. 1 is shown in greater detail. The sampling system 18 includes a probe 26, flowline 27, sample chambers 28A and 28B, pump 30 and fluid analyzer 32. The probe 26 has an intake 25 in fluid communication with a first portion 27*a* of flowline 27 for selectively drawing fluid into the downhole tool. Alternatively, a pair of packers (not shown) may be used in place of the probe. Examples of a fluid sampling system using probes and packers are depicted in U.S. Pat. Nos. 4,936,139 and 4,860,581, previously incorporated herein.

The flowline 27 connects the intake 25 to the sample chambers, pump and fluid analyzer. Fluid is selectively drawn into the tool through the intake 25 by activating pump 30 to create a pressure differential and draw fluid into the downhole tool. As fluid flows into the tool, fluid is preferably passed from flowline 27, past fluid analyzer 32 and into sample chamber 28B. The flowline 27 has a first portion 27A and a second portion 27B. The first portion extends from the probe through the downhole tool. The second portion 27B connects the first portion to the sample chambers. Valves, such as valves 29A and 29B are provided to selectively permit fluid to flow into the sample chambers. Additional valves, restrictors or other flow control devices may be used as desired.

As the fluid passes by fluid analyzer 32, the fluid analyzer is capable of detecting fluid content, contamination, optical density, gas oil ratio and other parameters. The fluid analyzer may be, for example, a fluid monitor such as the one described in U.S. Pat. No. 6,178,815 to Felling et al. and/or U.S. Pat. No. 4,994,671 to Safinya et al., both of which are hereby incorporated by reference.

The fluid is collected in one or more sample chambers 28B for separation therein. Once separation is achieved, portions of the separated fluid may either be pumped out of the sample chamber via a dump flowline 34, or transferred into a sample chamber 28A for retrieval at the surface as will be described more fully herein. Collected fluid may also remain in sample chamber 28B if desired. Alternatively, contaminated fluid may be pumped out of the sample chamber and into the borehole (flowline 34 in FIG. 2) or another chamber.

Figure 3B:
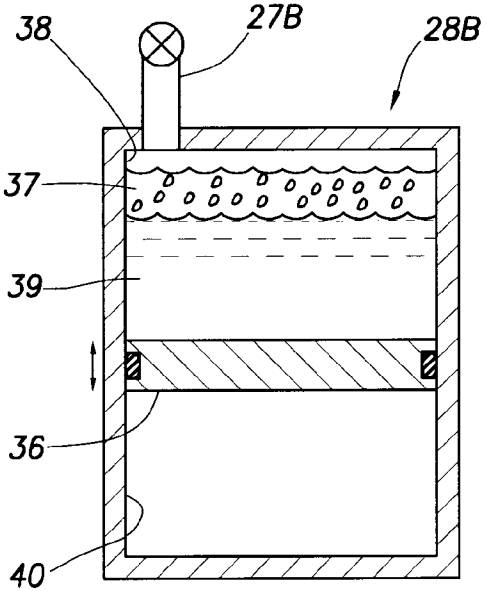
FIG. 3B is a detailed, schematic view of one of the sample chambers of FIG. 2 depicting separation of fluid with contamination rising to the top.
Figure 3A:
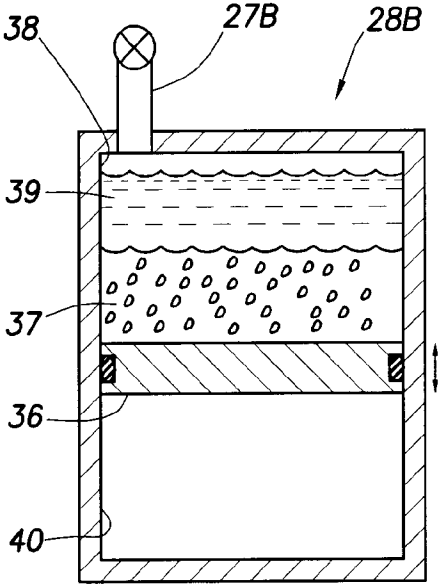
FIG. 3A is a detailed, schematic view of one of the sample chambers of FIG. 2 depicting separation of fluid with contamination falling to the bottom.

Referring to FIGS. 3A and 3B, separation of the fluid in sample chamber 28B is depicted in greater detail. FIGS. 3A and 3B depict a sample chamber having a piston 36 that separates the sample chamber into a sample cavity 38 for collecting sample fluid and a buffer cavity 40 containing a buffer fluid. As fluid flows into the sample cavity, the piston slidably moves within the sample chamber in response to the pressures in the cavities. Fluid begins to fill the chamber and separate. Typically, as depicted, contaminates and/or contaminated fluid 37 separates from the clean, formation fluid 39 in layers. Depending on the fluid properties, the contaminated fluid may settle at the bottom as depicted in FIG. 3A, or rise to the top as depicted in FIG. 3B.

The sample chamber of FIG. 3A is provided with a single flowline 27B for passing fluid into and out of the sample chamber. Once fluid is separated, the clean fluid depicted as rising to the top in FIG. 3A may be pumped out of the sample chamber 28B and into sample chamber 28A for collection therein (FIG. 2). Once the transfer is complete, the remaining contaminated fluid may be pumped out of dump line 34 and into the borehole. The fluid analyzer 32 may be used to monitor the fluid pumped into sample chamber 28A to verify that it is sufficiently clean fluid. Once contaminated fluid is detected, the transfer may be terminated. The transfer may be repeated between multiple chambers until the desired fluid is collected.

The sample chamber of FIG. 3B is also provided with a single flowline 27B for passing fluid into and out of the sample chamber. Once fluid is separated, the contaminated fluid depicted as rising to the top in FIG. 3B may be pumped out of the sample chamber 28B, through dump line 34 and into the borehole. If desired, the dump flowline may be positioned so that the contaminated fluid passes through the fluid analyzer 32 so that the contaminated fluid may be monitored. Once sufficiently clean fluid is detected, the transfer may be terminated. The transfer and/or dumping processes may be repeated until the desired fluid is collected.

Figure 4:
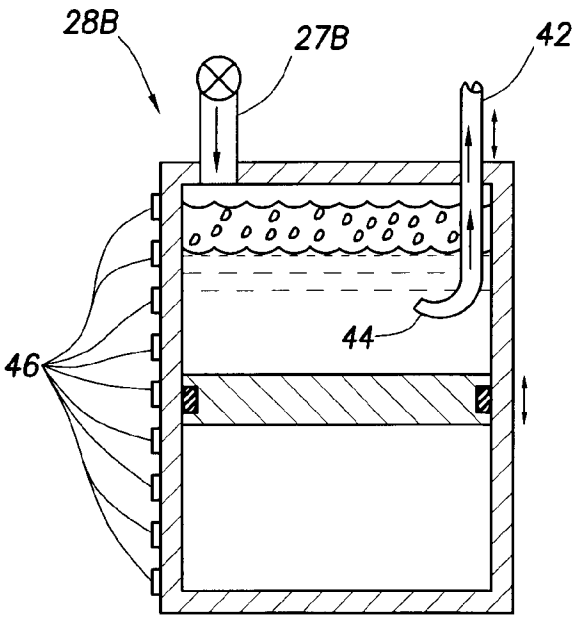
FIG. 4 is schematic view of an alternate embodiment of the sample chamber of FIG. 3B having a second flowline with a snorkel, and sensors.

Referring now to FIG. 4, the sample chamber 28B may be provided with a second flowline 42 for selectively removing fluids. With a second flowline and valve, fluid may be passed into the sample cavity via flowline 27B and removed via flowline 42. When removing formation fluid, the flowline 42 as depicted in FIG. 4, is preferably provided with a snorkel 44 for facilitating the capture and removal of fluid into flowline 42. The snorkel may be positioned at various levels in the sample chamber to obtain removal of the desired fluid. In this way, if the clean fluid falls to the bottom of the sample cavity, the snorkel may be lowered to the desired level to remove a lower layer of fluid, in this case, the clean fluid.

The sample chamber may be provided with sensors 46 positioned along the sample chamber wall. These sensors may be used to detect the location of fluid and/or various fluid properties (ie. density, viscosity) in the sample chamber. The sensors may also be used to detect the location of pistons, flowlines, snorkels, or other items within the chamber.

Figure 5:
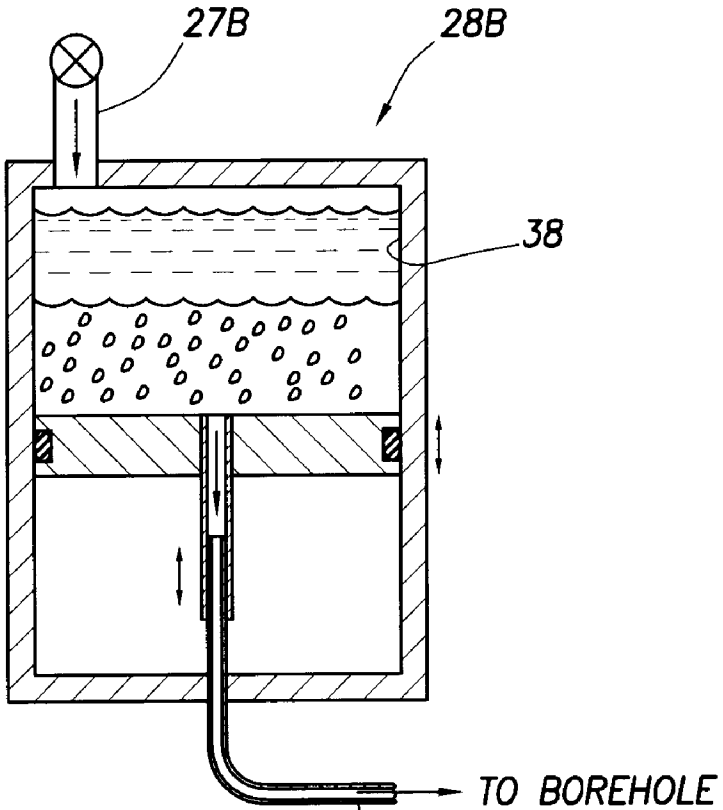
FIG. 5 is a schematic view of an alternate embodiment of the sample chamber of FIG. 3A having a dump flowline.

Various configurations of flowlines may be positioned for entry or removal of fluid in the sample chamber. While flowline 27B is depicted as being at the top left of the chamber, the flowlines may be positioned at various locations to facilitate the sampling and/or separation processes. As shown in FIG. 5, fluid enters the sample chamber 28B via flowline 27B. The second flowline 48 is passes through the piston and the buffer cavity. This permits removal of the fluid at the bottom of sample cavity 38 via flowline 48. As the piston moves, the second flowline preferably moves with the piston. The flowline may be telescoping as shown to permit the tube to extend and retract with the piston.

Figure 6:
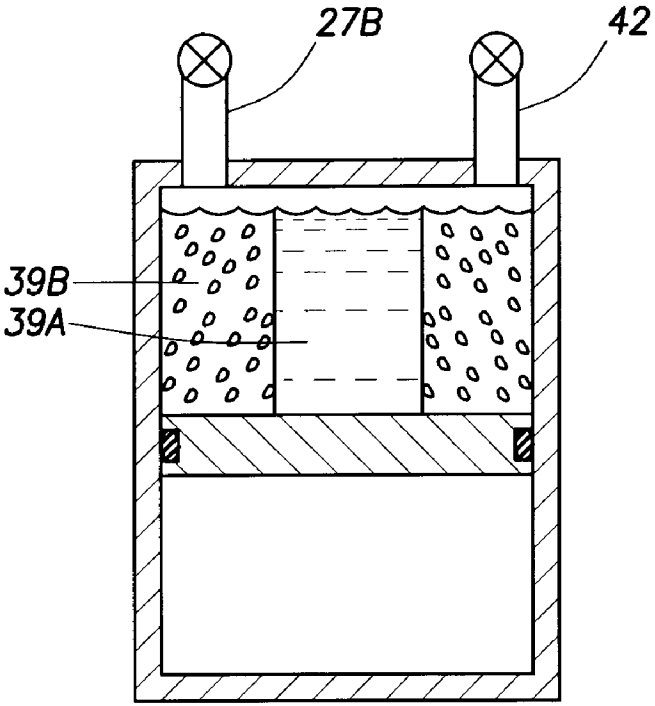
FIG. 6 is a schematic view of an alternate embodiment of the sample chamber of FIG. 3A or 3B depicting radial separation therein.

Another sample chamber configuration is depicted in FIG. 6. As described above, the downhole tool may be a drilling tool. In such cases (and some others), the tool rotates and typically applies a centripetal force to the sample cavity. This centripetal force rotates the fluid and causes it to separate into radial layers. As shown in FIG. 6, the central portion of the sample cavity may be clean fluid 39A, while the outer layer is contaminated 39B (or vice versa not shown). The flowlines may be positioned such that one flowline, such as the flowline 27B, is located centrally while the second flowline 42 is located at or near the outer layer. Other configurations may be envisioned.

Figure 7:
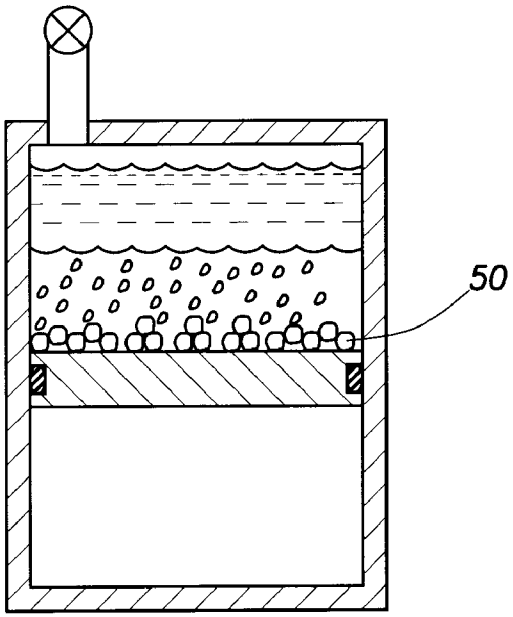
FIG. 7 is a schematic view of the sample chamber of FIG. 3A or 3B having pebbles therein.

Various techniques may be employed to facilitate the separation process. For example as shown in FIG. 7, pebbles 50 may be placed in the sample cavity to assist in pulling certain fluids toward the bottom of the chamber. Various chemical additives, such as demulsifiers (ie. sodium lauryl sulfate) may also be inserted into the fluid to assist in separation. Agitation, such as the centripetal rotation of the tool, may also assist in separation.

Figure 8:
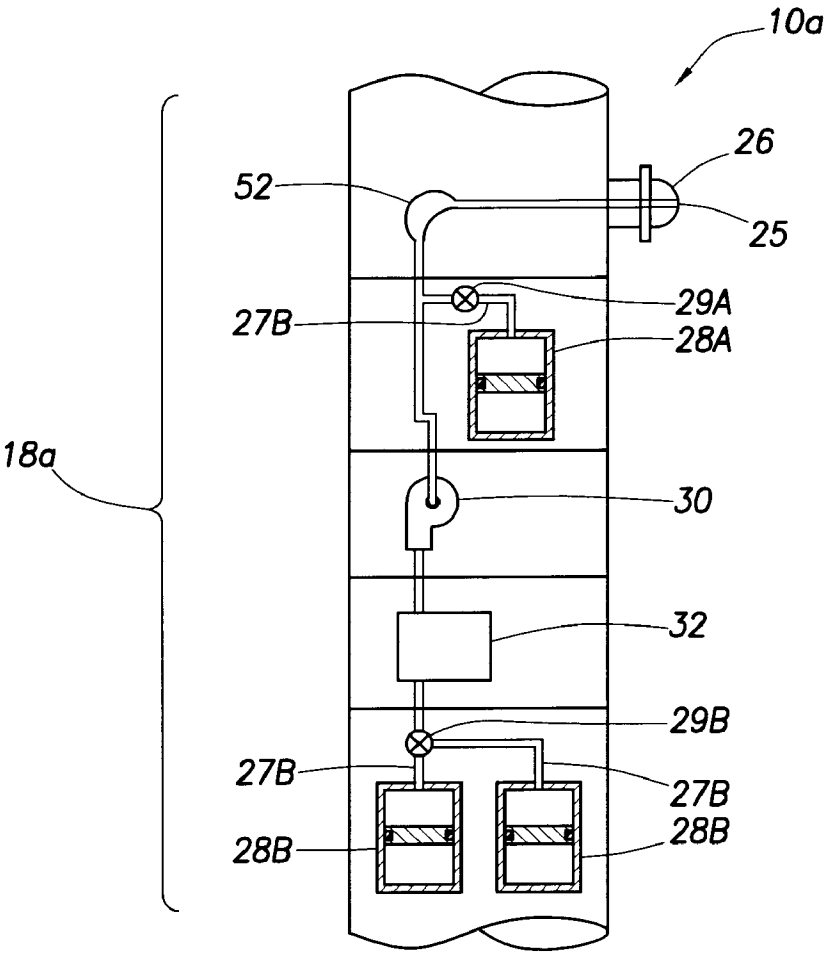
FIG. 8 is a schematic view of an alternate embodiment of the downhole tool of FIG. 2 depicting another configuration of the sampling system having a gas accumulator.

Referring now to FIG. 8, another embodiment of the downhole tool 10*a* of FIG. 2 is depicted. This downhole tool 10*a* is the same as the downhole tool 10 of FIG. 2, except that it is a drilling tool including a fluid sampling system 18*a* with multiple sample chambers 28B and a gas accumulator 52. Additionally, the various components and modules have been rearranged. The downhole tool 10*a* shows that a variety of configurations may be used. In cases where the tool is modular, the modules may be re-arranged as desired to allow a variety of other operations in the downhole tool. Multiple sample chambers may be used with a variety of valving options. The fluid analyzer and pump may be positioned as desired to allow for monitoring and movement as desired.

The tool may be provided with additional devices, such as a gas accumulator 52, capable of allowing gas bubbles to gather and consolidate. Once the gas collects to a sufficient size, it will move as a single slug for more efficient separation and disposal.

The tool may also be provided with sensors at various positions, such as in the sample chamber as depicted in FIG. 4, or at various positions in the sampling system. These sensors may determine a variety of readings, such as density and resistivity. This information may be used alone or in combination with other information, such as the information generated by the fluid analyzer. The data collected in the tool may be transmitted to the surface and/or used for downhole decision making. Appropriate computer devices may be provided to achieve these capabilities.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A downhole sampling tool for sampling a formation fluid from a subterranean formation, comprising:

a probe for drawing the formation fluid from the subterranean formation into the downhole tool;

a main flowline extending from the probe for passing the formation fluid from the probe into the downhole tool;

at least one sample chamber operatively connected to the main flowline for collecting the formation fluid therein, the sample chamber including a contaminated portion and a clean portion of the formation fluid; and an exit flow line operatively connected to the sample chamber for selectively removing one of the contaminated portion of the formation fluid, and the clean portion of the formation fluid from the sample chamber whereby contamination is removed from the formation fluid.

2. The sampling tool of claim 1 wherein the tool is selected from the group of wireline tool, drilling tool, coiled tubing tool or combinations thereof.

3. The sampling tool of claim 1 wherein the at least one sample chamber comprises a first sample chamber and a second sample chamber, the downhole tool further comprising a transfer flowline for passing at least a portion of the formation fluid from the first sample chamber to the second sample chamber.

4. The sampling tool of claim 1 wherein the exit flow line is operatively connected to a second sample chamber for passing at least a portion of the formation fluid from the first sample chamber to the second sample chamber.

5. The sampling tool of claim 1 further comprising a dump flowline for passing fluid from the main flowline to the borehole.

6. The sampling tool of claim 1 further comprising sensors for detecting formation parameters.

7. The sampling tool of claim 6 wherein the sensors are positioned in at least one of the flowlines, the at least one sample chambers or combinations thereof.

8. The sampling tool of claim 1 further comprising a fluid analyzer capable of monitoring contamination of the formation fluid.

9. The sampling tool of claim 1 further comprising a fluid separator.

10. The sampling tool of claim 9 wherein the fluid separator comprises one of pebbles, chemicals, catalysts, activators, demulsifiers or combinations thereof.

11. The sampling tool of claim 1 wherein the at least one sample chambers have a piston slidably movable therein, the piston separating the sample chamber into a sample cavity and a buffer cavity.

12. The sampling tool of claim 1 wherein the exit flowline extends from the at least one sample chamber to the borehole for dumping contaminated fluid from the sample cavity into the borehole.

13. The sampling tool of claim 1 wherein the exit flowline extends from the at least one sample chamber to a collection chamber for collecting the formation fluid.

14. The sampling tool of claim 1 wherein the exit flowline is provided with a snorkel positionable in the sample chamber for selective removal of at least a portion of the formation fluid therefrom.

15. The sampling tool of claim 1 further comprising a gas accumulator operatively coupled to the main flowline, the accumulator capable of allow gas bubbles to group together before passing into the sample chamber.

16. A method for sampling a formation fluid from a subterranean formation via a downhole tool, the method comprising:

positioning a downhole tool in a wellbore;

establishing fluid communication between the downhole tool and the surrounding formation;

drawing fluid from the formation into the downhole tool;

collecting the formation fluid in at least one sample chamber, the formation fluid including a contaminated portion and a clean portion; and withdrawing one of the contaminated portion of the formation, and the clean portion of the formation fluid from the sample chamber.

17. The method of claim 16 further comprising separating the clean portion of the formation fluid from the contaminated portion of the formation fluid.

18. The method of claim 17 wherein the fluid is separated by withdrawing the contaminated portion from the sample chamber.

19. The method of claim 18, wherein the contaminated portion is dumped into the borehole.

20. The method of claim 17 wherein the fluid is separated by one of allowing it to settle, agitation, additives or combinations thereof.

21. The method of claim 20, wherein the additives are pebbles, demulsifiers or combinations thereof.

22. The method of claim 17, wherein the fluid is separated by transferring the clean portion into a collection chamber.

23. The method of claim 16 further comprising identifying one of a clean portion of the formation fluid, a contaminated portion of the formation fluid or combinations thereof.

24. A sampling system for removing contamination from a formation fluid collected by a downhole tool from a subterranean formation, comprising:

at least one sample chamber positioned in the downhole tool for receiving the formation fluid; and an exit flow line operatively connected to the sample chamber containing a contaminated portion and a clean portion of the formation fluid for selectively removing one of the contaminated portion of the formation fluid, and the clean portion of the formation fluid from the sample chamber whereby contamination is removed from the formation fluid.

25. The sampling system of claim 24 wherein the tool is selected from the group of wireline tool, drilling tool, coiled tubing tool or combinations thereof.

26. The sampling system of claim 24 wherein the at least one sample chamber comprises a first sample chamber and a second sample chamber, the sampling system further comprising a transfer flowline for passing at least a portion of the formation fluid from the first sample chamber to the second sample chamber.

27. The sampling system of claim 24 wherein the exit flow line is operatively connected to a second sample chamber for passing at least a portion of the formation fluid from the first sample chamber to the second sample chamber.

28. The sampling system of claim 24 further comprising a dump flowline for passing fluid from the main flowline to the borehole.

29. The sampling system of claim 24 further comprising sensors for detecting formation parameters.

30. The sampling system of claim 29 wherein the sensors are positioned in at least one of the flowlines, the at least one sample chambers or combinations thereof.

31. The sampling system of claim 24 further comprising a fluid analyzer capable of monitoring contamination of the formation fluid.

32. The sampling system of claim 24 further comprising a fluid separator.

33. The sampling system of claim 32 wherein the fluid separator comprises one of pebbles, chemicals, catalysts, activators, demulsifiers or combinations thereof.

34. The sampling system of claim 24 wherein the at least one sample chambers have a piston slidably movable therein, the piston separating the sample chamber into a sample cavity and a buffer cavity.

35. The sampling system of claim 24 wherein the exit flowline extends from the at least one sample chamber to the borehole for dumping contaminated fluid from the sample cavity into the borehole.

36. The sampling system of claim 24 wherein the exit flowline extends from the at least one sample chamber to a collection chamber for collecting the formation fluid.

37. The sampling system of claim 24 wherein the exit flowline is provided with a snorkel positionable in the sample chamber for selective removal of fluid therefrom.

38. The sampling system of claim 24 further comprising a gas accumulator operatively coupled to the main flowline, the accumulator capable of allow gas bubbles to group together before passing into the sample chamber.

* * * * *